US007204117B2

(12) United States Patent
Friedrichs

(10) Patent No.: US 7,204,117 B2
(45) Date of Patent: Apr. 17, 2007

(54) METHOD AND DEVICE FOR PRODUCING A HARD METAL TOOL

(76) Inventor: Arno Friedrichs, Grünbaum 3, 95326 Kulmbach (DE)

( * ) Notice: Subject to any disclaimer, the term of this patent is extended or adjusted under 35 U.S.C. 154(b) by 0 days.

(21) Appl. No.: 10/541,172

(22) PCT Filed: Dec. 24, 2003

(86) PCT No.: PCT/EP03/14906

§ 371 (c)(1),
(2), (4) Date: Jun. 30, 2005

(87) PCT Pub. No.: WO2004/060588

PCT Pub. Date: Jul. 22, 2004

(65) Prior Publication Data

US 2006/0162415 A1 Jul. 27, 2006

(30) Foreign Application Priority Data

Jan. 2, 2003 (DE) ..... 103 00 283

(51) Int. Cl.
*B21C 23/22* (2006.01)

(52) U.S. Cl. ..... 72/258; 72/17.3; 72/19.9; 72/271

(58) Field of Classification Search ..... 72/17.3, 72/19.8, 19.9, 253.1, 258, 260, 271, 468
See application file for complete search history.

(56) References Cited

U.S. PATENT DOCUMENTS 3,457,760 A 7/1969 Cassidy et al.
3,600,918 A * 8/1971 Lemelson ..... 72/7.4
4,059,031 A 11/1977 Erdelyi
4,208,898 A * 6/1980 Ames et al. ..... 72/258
4,762,445 A 8/1988 Bunting et al.
5,438,858 A 8/1995 Friedrichs
5,495,656 A 3/1996 Waggoner
5,598,731 A * 2/1997 Riviere et al. ..... 72/260
5,601,857 A 2/1997 Friedrichs
5,780,063 A 7/1998 Friedrichs
5,904,939 A 5/1999 Friedrichs
6,363,608 B1 * 4/2002 Koike et al. ..... 29/888.04
6,450,739 B1 * 9/2002 Puide et al. ..... 408/144

FOREIGN PATENT DOCUMENTS

| | | |
|---|---|---|
| DE | 25 12 854 | 3/1975 |
| DE | 4021383 | 1/1992 |
| DE | 41 20 165 | 12/1992 |
| DE | 4120166 | 1/1993 |
| DE | 102 29 325 | 1/2004 |

(Continued)

*Primary Examiner*—Ed Tolan
(74) *Attorney, Agent, or Firm*—Collard & Roe P.C.

(57) ABSTRACT

The method has a first material of lesser hardness acting as a rod-shaped carrier for a second material of greater hardness, each materials formed within a respective extrusion press tool and the plastic mass flow of the greater hardness material fed to the extrusion press tool for the lesser hardness material for providing a common plastic mass flow in the form of a rod-shaped body with a core and an outer region. An Independent claim for a device for manufacture of a hard metal workpiece is also included.

16 Claims, 3 Drawing Sheets

FOREIGN PATENT DOCUMENTS

| | | |
|---|---|---|
| DE | 102 29 326 | 1/2004 |
| GB | 882 693 | 11/1961 |
| JP | 55109518 | 8/1980 |
| JP | A 60 059 001 | 4/1985 |
| JP | 1-309718 | * 12/1989 |
| JP | 03032418 | 2/1991 |
| JP | 11342416 | 12/1999 |
| WO | WO 01 17705 | 3/2001 |

* cited by examiner

S1
S2
S3
S4
21
SS
9d
9b
9
9c
22
SS
9b
9d
9c
9b
9d'
9c'
5b
10a
13
14
10b
2
4
20
5a
3
19
18
S2
23
3a
3b
1a
S4
24
12
11a
16
15a
P1
15
P2
7
1
7
7
11
P3
6
8
17
S1
S3

METHOD AND DEVICE FOR PRODUCING A HARD METAL TOOL

CROSS REFERENCE TO RELATED APPLICATIONS

Applicant claims priority under 35 U.S.C. §119 of GERMAN Application No. 103 00 283.9 filed on Jan. 2, 2003. Applicant also claims priority under 35 U.S.C. §365 of PCT/EP2003/014906 filed on DEC. 24, 2003. The international application under PCT article 21(2) was not published in English.

This application is a 35 U.S.C. 371 of PCT/EP03/14906 filed Dec. 24, 2003.

The invention relates to a method for producing a bar-shaped hard metal tool comprising at least two materials of different hardness, in which the first material has the lower hardness and forms a bar-shaped support for the second, harder material.

Methods of producing bar-shaped hard metal tools, particularly hard metal drilling tools are known from, for example, DE 40 21 383 C2, DE 41 20 166 C2, WO 01/17705 A2, DE 102 29 325.2 and DE 102 29 326.0. In these known methods there is used in each instance an extrusion tool by means of which a cylindrical body consisting of a plastic mass is produced, the body having one or more recesses extending in its interior. The extrusion tool comprises an extrusion nozzle with a tapering region and a nozzle mouthpiece which forms a cylindrical channel. None of these known methods serves for producing a bar-shaped hard metal tool which comprises at least two materials of different hardness and in which the first material has the lower hardness and forms a bar-shaped support for the second, harder material.

A method of producing a drilling tool, which has a cylindrical base body, is known from U.S. Pat. No. 4,762,445 A. This is conically formed in one end region. It consists of a first material, for example tungsten-carbide, which is fracture-proof, tough, easily capable of soldering or welding and readily sharpenable. Grooves are formed, in particular ground, in this base body. These grooves are filled with a second, extremely hard material, for example diamond or cubic boron nitride. A sintering process is subsequently carried out with use of high pressure and high temperature in order to fixedly connect the two materials together. The said grooves are formed and positioned in such a manner that the diamond layer or the cubic boron nitride forms the cutting edge of the drilling tool.

The disadvantage of this known procedure consists in that introduction of grooves into the base body, which is usually carried out by means of a grinding process, is costly. The ground grooves have only a small depth, i.e. they have only a small extent in longitudinal direction of the tool. This has the disadvantage that the ultimately produced drilling tool can at most be reground a few times and for this reason can be used only for a limited time.

It is already known from GB 882 693 A to feed together mass flows of different metallic materials. This takes place with use of a nozzle arranged between two containers. The mass flows are provided by different press pistons, the extensions of which each protrude into one of the containers. The object of this citation is production of a bimetal with an eccentrically disposed centre of tensile force. Production of a two-component metal bar in which one of the components completely surrounds the other component is not possible by means of the method described in GB 882 693 A.

Similarly, it is already known from U.S. Pat. No. 3,457,760 A to feed together mass flows of different metallic materials. This takes place with use of a special mechanism comprising an electrically heated container. An already present two-component metal bar, in which the second metal component forms a coating of the first metal component, is fed to this container. The said metal components are forced through a specially shaped nozzle with use of a press piston. A two-component metal bar, in which the second metal component forms a coating of the first metal component, is provided at the outlet of the nozzle. By means of the method described in U.S. Pat. No. 3,457,760 A it is possible to undertake merely cross-sectional changes of a bar which is already present.

A method of producing a rod-shaped blank which comprises at least two different materials and in which the first material forms a rod-shaped support for the second material is already known from JP-A-60 059 001 and the associated English-language translation of the Abstract. This known method is carried out by means of a press tool which has a second cylinder arranged within a first cylinder. The two cylinders have, at the outlet end, nozzles through which the extruded material is issued in the form of a common plastic mass flow.

The invention has the object of indicating a route to production of a hard metal tool in which the afore-described disadvantages do not arise.

This object is fulfilled by a method with the features indicated in claim 1. Advantageous refinements and developments are indicated in the dependent claims 2 to 10. Claims 11 to 16 relate to a device for carrying out the method according to any one of claims 1 to 10.

The advantages of the invention consist particularly in that introduction of grooves into the base body is not necessary, since the second material is already introduced into the first material during the extruding. This makes it possible, in particular, to also introduce the second material not only into the edge regions, but also into the inner regions of the first material. The second material can have a substantial extent in axial direction of the bar-shaped tool so that frequent regrinding of the tool can be readily carried out. This significantly prolongs the service life of the tool.

Further advantageous characteristics of the invention are evident from the following explanation of examples of embodiment by reference to the figures, in which:

FIG. 1 shows a sketch for clarification of a first example of embodiment for the invention. The basic mode of function of the invention is explained on the basis of this diagram.

Figure 1:
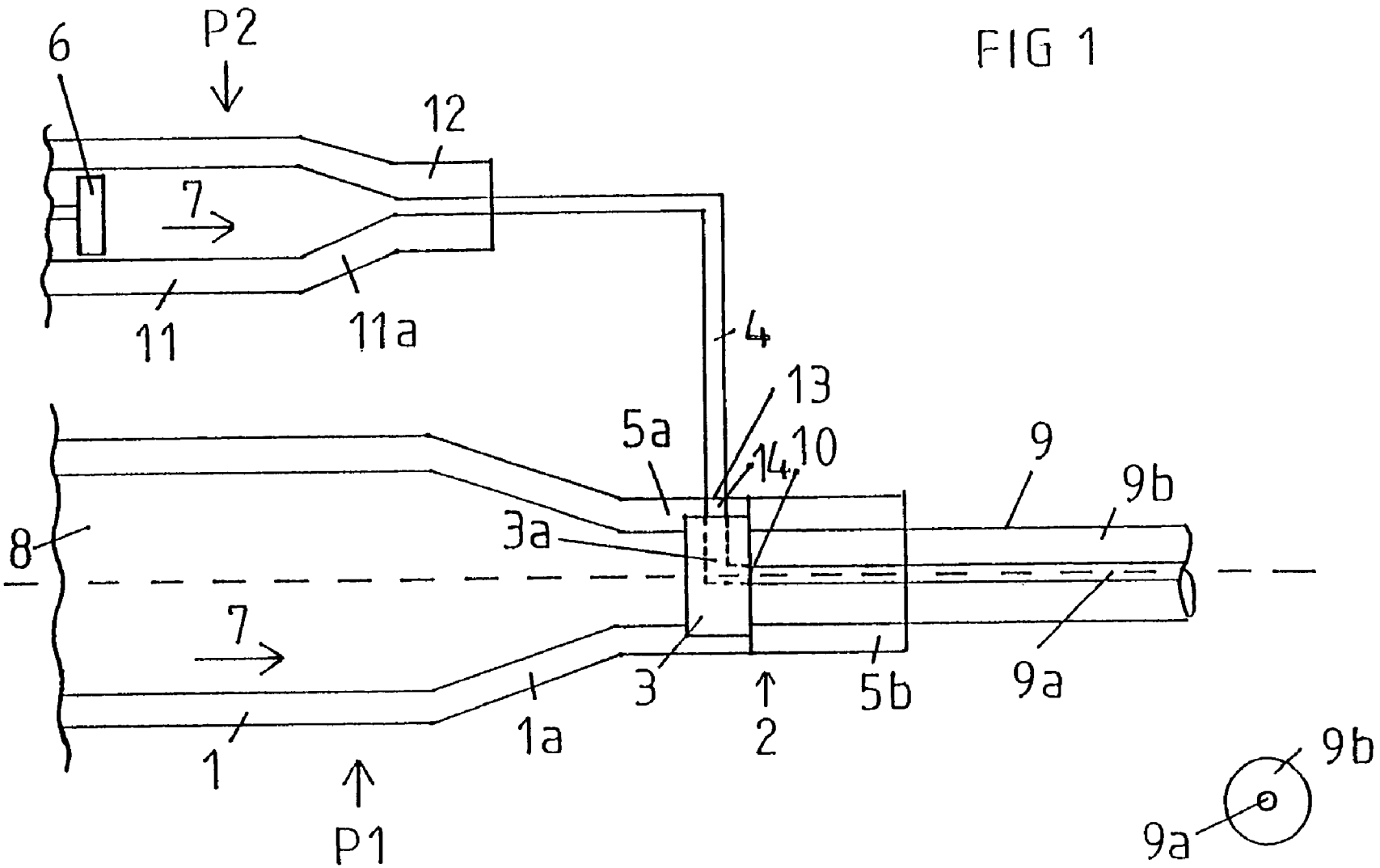
FIG. 1 shows a diagram for clarification of a first example of embodiment for the invention.

A bar-shaped blank for a hard metal tool, which comprises two materials of different hardness, is produced by means of the device illustrated in FIG. 1. The first material has the lower hardness and forms a bar-shaped support for the second, harder material. The first material is a hard metal having a high level of toughness and thereby fracture-proof to a high degree. Since the first material forms the support for the second material, the ultimately produced tool is fracture-proof by virtue of the toughness of the first material. The second, harder material is preferably similarly a hard material, but has a composition different from that of the first material so as to ensure the desired greater hardness. The second, harder material in this example of embodiment forms the core of the first material, i.e. the centre axle thereof extending in longitudinal direction, but according to further examples of embodiment not illustrated in the figure can also be arranged eccentrically.

Production of a tool of that kind takes place as follows:

In a first extrusion tool P1 the first material, which is present in the form of a plastic mass flow 8, is forced through the wide region 1 of an extrusion nozzle in direction 7 towards the nozzle mouthpiece 2. A tapering region 1*a* is provided between the wide region 1 and the nozzle mouthpiece 2. The nozzle mouthpiece forms a cylindrical channel.

The second material is provided by a second extrusion tool P2. In this second extrusion tool the second material, which is similarly present in the form of a plastic mass flow, is pressed through the wide region 11 in direction 7 towards the nozzle mouthpiece 12. A tapering region 11*a* is provided between the wide region 11 and the nozzle mouthpiece 12. The nozzle mouthpiece 12 forms a cylindrical channel through which the second material in the form of a mass flow is delivered to a feed duct 4. This feed duct 4 is provided between the two extrusion tools P1 and P2. The material provided by the second extrusion tool P2 is conducted by this feed duct to the first extrusion tool P1. The first extrusion tool P1 has in the region of the extrusion nozzle, preferably in the region of the nozzle mouthpiece 2, an inlet opening 13 through which the second material provided by way of the feed duct 4 is received.

The nozzle mouthpiece 2 is of two-part construction in the illustrated example of embodiment, wherein the first part 5*a* is formed integrally with the wide region 1 and the tapering region 1*a* of the press nozzle. The second part 5*b* of the nozzle mouthpiece 2 forms the end region thereof, which can be removed, for example unscrewed, from the first part 5*a*.

A mount 3, which can be a concentric mounting ring, is inserted into the first region 5*a* of the nozzle mouthpiece 2. This mount can be easily inserted into the extrusion tool P1 and also easily removed therefrom again when the end region 5*b* is taken off.

The mount 3 has a channel 3*a*, the termination of which forms a mount outlet nozzle 10. The channel 3*a* is connected at the inlet end with a channel 14 provided in the housing of the nozzle mouthpiece 2.

The second material produced by the second extrusion tool P2 and provided by way of the feed duct 4 enters the first extrusion tool P1 via the inlet opening 13 and is there passed on by the channel 14 to the channel 3*a* of the mount 3. The second material issuing from the outlet nozzle 10 of the mount 3 is forced into the first mass flow. Since the outlet nozzle 10 is arranged centrally in the illustrated example of embodiment the second material forms the core of the first material after being forced in.

Consequently, the cylindrical body 9 issued from the first extrusion tool P1 has a support which forms the entire outer region 9*b* of the cylindrical body 9 and consists of the first material. The core 9*a* of the cylindrical body 9 is formed by the second material. This is clarified in the form of a cross-sectional illustration in FIG. 1 at the bottom right.

Alternatively to the afore-described example of embodiment the following modifications are possible:

A first modification consists in that the mount 3 is to be designed not in the form of a mounting ring, but in the form of a pin-shaped mounting element. A second modification consists in that the second material is to be forced into the first material not in the form of a mass flow having a circular cross-sectional area, but in the form of a mass flow having a non-round cross-sectional area. An elongate cross-sectional shape extending over half or even over the entire inner diameter of the nozzle mouthpiece is, for example, advantageous. This procedure allows, for example, production of a drilling tool in which the cutting region is formed by the second, harder material.

According to all that, the illustrated example of embodiment discloses a method and a device for producing a bar-shaped hard metal tool having two materials of different hardness. The first material has the lower hardness and forms a bar-shaped support for the second, harder material. The first material is pressed within a first extrusion tool in the form of a plastic mass flow in the direction of the nozzle mouthpiece of an extrusion nozzle. The second material, which is present in the form of a plastic mass flow and which is preferably provided by a second extrusion tool, is forced within the first extrusion tool into the first mass flow.

The bar-shaped, preferably cylindrical body issued from the first extrusion tool P1 is further processed to form a finished hard metal tool, preferably a hard metal drilling tool or a hard metal milling tool.

Within the scope of this further processing the body leaving the first extrusion tool P1 is cut to length outside the extrusion tool P1 to a desired length. Subsequently, the body cut to length can be uniformly twisted by means of a surface friction arrangement such as described in more detail in, for example, WO 01/17705 A2. The cut-to-length and twisted or untwisted body is dried, optionally provided at its outer circumference with one or more chip chambers and finally sintered.

Through this procedure there is obtained a hard metal tool which, by virtue of the characteristics of the first material, is fracture-proof and, by virtue of the characteristics of the second material, is extremely hard in the working range.

Figure 2:
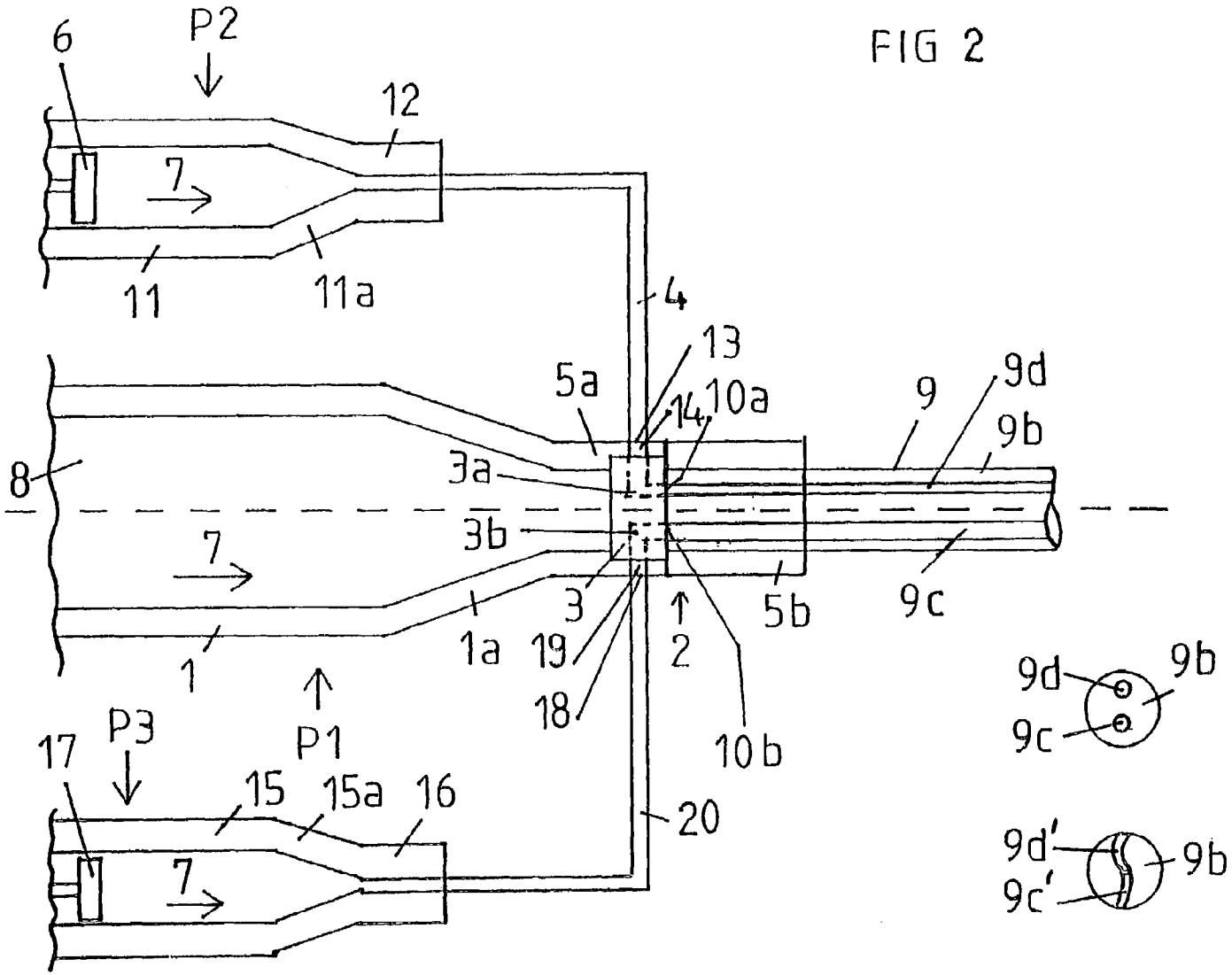
FIG. 2 shows a diagram for clarification of a second example of embodiment for the invention.

FIG. 2 shows a diagram for clarification of a second example of embodiment for the invention, which corresponds with a development of the example of embodiment shown in FIG. 1. According to this second example of embodiment additionally a third material, which either has the same characteristics as the second material or which has other desired characteristics, is provided with use of a third extrusion tool P3. This third material is fed to the first extrusion tool P1 by way of a further feed duct 20. The third material produced by the third extrusion tool P3 and provided by way of the feed duct 20 enters via an inlet opening 18 into the first extrusion tool P1 and is there passed on by a channel 19 to a channel 3*b* of the mount 3. The third material issuing from the outlet nozzle 10*b* of the mount 3 is forced into the first mass flow just as the second material issuing from the outlet nozzle 10*a* of the mount 3.

In this example of embodiment a cylindrical body 9 issues from the first extrusion tool P1. This body has a support which forms the entire outer region of the cylindrical body and consists of the first material. Two inserts are provided within this support 9*b* as evident from the upper cross-sectional illustration in FIG. 2 at the bottom right. The insert 9*d* consists of the second material and the insert 9*c* of the third material.

A modification of the example of embodiment according to FIG. 2 consists in that the outlet nozzles 10*a* and 10*b* of the mount 3 are selected to be rectangular in such a manner that the inserts 9*c*' and 9*d*' form the cutting edges in the finished drilling tool. This is clarified in the lower cross-sectional illustration in FIG. 2 at the bottom right. The curved-form of the inserts can be achieved in that the outlet nozzles 10*a* and 10*b* of the mount 3 already have a curved shape or in that the cylindrical body issuing from the first extrusion tool P1 is initially cut to length outside the first extrusion tool P1 and then twisted in desired manner.

Figure 3:
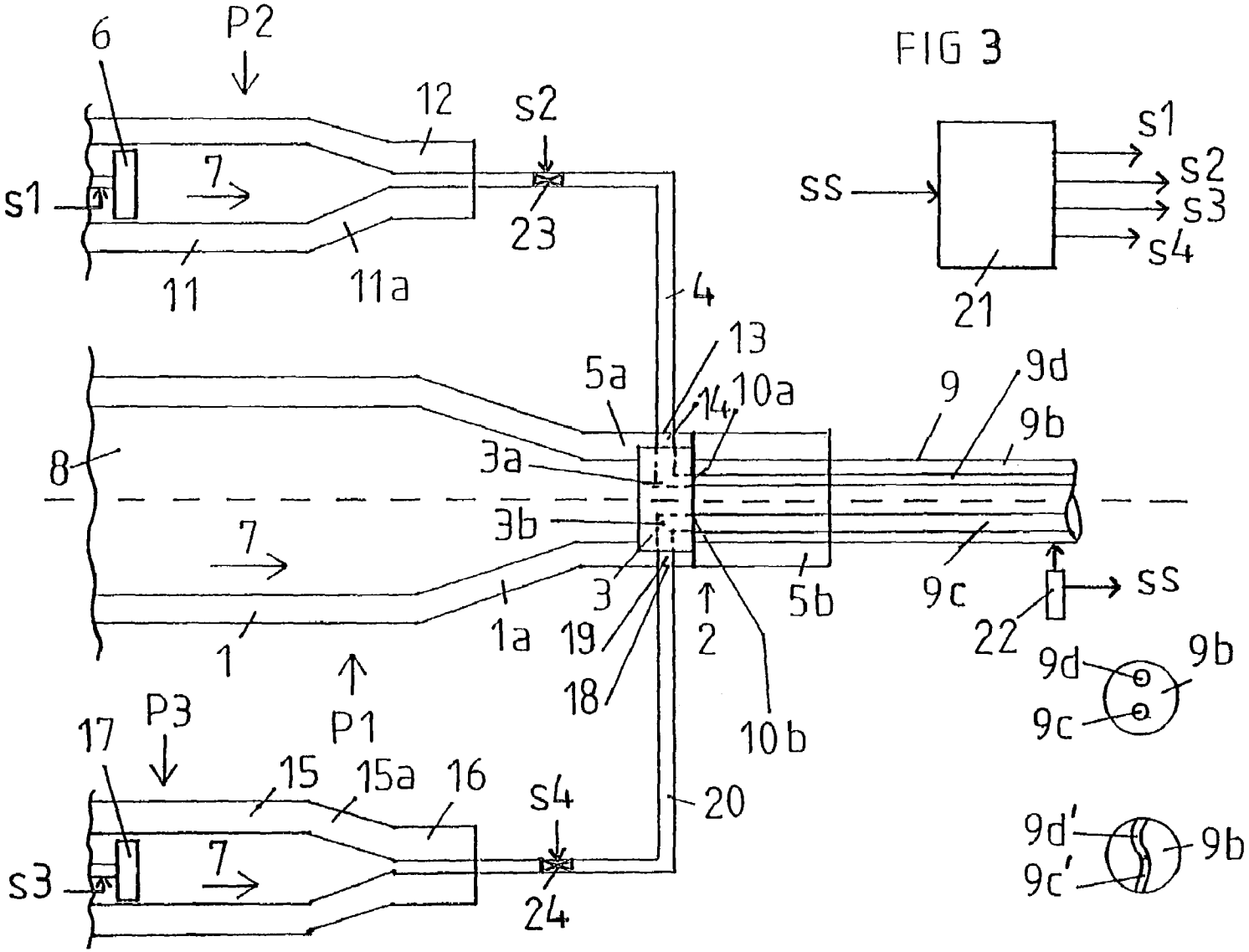
FIG. 3 shows a diagram for clarification of a third example of embodiment for the invention.

FIG. 3 shows a diagram for clarification of a third example of embodiment for the invention, which corresponds with a development of the example of embodiment shown in FIG. 2.

In this example of embodiment a control unit 21, sensor system 22, valve 23 and valve 24 are provided additionally to the example of embodiment shown in FIG. 2. The valve 23 is disposed between the second extrusion tool P2 and the first extrusion tool P1 in the feed duct 4. The valve 24 is arranged between the third extrusion tool P3 and the first extrusion tool P1 in the feed duct 20. The sensor system 22 is provided outside the first extrusion tool P1 in the outlet region of the cylindrical body 9 and serves for travel or outlet speed measurement or detection when the cylindrical body issued from the first extrusion tool P1 has reached a predetermined position. When the issued cylindrical body has reached the predetermined position a sensor system 22 provides an output signal ss.

This is fed to the control unit 21 and taken into consideration by this in the determination of control signals s1, s2, s3 and s4. The control signal s1 serves for setting the speed of movement of the piston 6 arranged in the second extrusion tool P2. The control signal s2 serves for controlling the valve 23. The control signal s3 serves for setting the speed of movement of the piston 17 provided in the third extrusion tool P3. The control signal s4 serves for controlling the valve 24. Further control signals of the control unit 21 serve for setting the volume flow of the first material in the first extrusion tool P1.

The said control or setting of the volume flows is carried out in such a manner that, for example, the second and third material, which forms the cutting region of the later drilling tool, is forced into the first material only in the front half of the drilling tool. The circumstance is thereby taken into account that the rear region of the finished drilling tool is clamped in a drill chuck during working operation and at no time forms the cutting region. This procedure is connected with a saving of costs, since the second material and third material, which form the cutting region of the drilling tool and for this reason have to be extremely hard, are in general substantially more expensive than the first material, which has a lesser hardness.

Preferably, all materials employed are hard material components each having the desired characteristics. This also has the advantage of simplified recycling, because the entire product merely consists of hard metal components. No solder connections are present and also no different substances have to be disposed of.

Alternatively thereto, however, it is also possible to use, as harder material which forms the cutting region of the later drilling tool, polycrystalline diamond (PCD) which is also used in previously known drilling tools in the cutting region.

The method according to the invention and the device according to the invention can, according to all that, be used for the purpose of producing bar-shaped hard metal drilling or milling tools, which have as support material a first hard metal type with a high degree of toughness and comparatively low hardness. Hard metal types of that kind have, for example, a high cobalt proportion and a comparatively coarse grain size which is not suitable for the cutting region of a hard metal tool. Hard metal categories of that kind are comparatively favourable in price. Within the scope of an extrusion process there is forced into this support material a cutting material which is preferably a hard metal type with a very high degree of hardness and very fine grain size in order to do justice to the requirements in the cutting region of a hard metal tool. Alternatively thereto, bpolycrystalline diamond can also be used in the cutting region.

The produced tools can also be reamers.

The produced tools can—as is known from, for example, WO 01/17 705 A2—have internally disposed cooling channels through which a liquid coolant is led to the working region of the respective tool during working operation thereof.

Alternatively to the above forms of embodiment there can also be used, instead of piston presses, also worm presses when the volume flow is known for every press participating in the production process.

The invention claimed is:

1. A method of producing a bar-shaped hard metal tool comprising at least two materials of different hardness, wherein the first material has the lower hardness and forms a bar-shaped support for the second, harder material, wherein the first material is provided within a first extrusion tool in the form of a plastic first mass flow, the second material is provided within a second extrusion tool similarly in the form of a plastic second mass flow, the second material is fed to the first extrusion tool by way of a channel connecting the two extrusion tools and forced within the first extrusion tool into the first mass flow, a common plastic mass flow of the first and second material is issued from the first extrusion tool as a bar-shaped body in which the first material forms a bar-shaped support for the second material and the bar-shaped body issued from the first extrusion tool is further processed to form a hard metal tool, wherein output signals of a sensor are coupled to a control unit, and wherein the control unit generates control signals such that volumes of the first and second mass flows are controlled individually.

2. The method according to claim 1, wherein the second material is forced into the first mass flow with use of a nozzle.

3. The method according to claim 2, wherein the second material is forced into the first mass flow with use of a nozzle with a non-round cross-sectional shape.

4. The method according to claim 3, wherein the second material is forced into the first mass flow with use of a nozzle with elongate cross-sectional shape.

5. The method according to claim 1, wherein a cylindrical body exits from the first extrusion tool at an exit speed and measurement of the exit speed of the cylindrical body from the first extrusion tool is carried out by means of a sensor.

6. The method according to claim 5, wherein the first and second mass flows have respective speeds undertaken by respective control of the movement of a piston in dependence on the output signals of the sensor.

7. The method according to claim 1, wherein the material provided by means of the second extrusion tool is conducted to the first extrusion tool by way of a controlled valve.

8. The method according to claim 7, wherein the valve is controlled in dependence on the output signals of a sensor.

9. The method according to claim 6, wherein control of the movement of the piston and/or the valve is undertaken in such a manner that forcing of the second material into the first mass flow takes place only within predetermined time intervals in such a manner that the second material is forced merely into a front region of the cylindrical body leaving the first extrusion tool.

10. The method according to claim 1, wherein further materials each present in the form of a plastic mass flow are forced into the first mass flow within the first extrusion tool.

11. A device for carrying out the method according to claim 1, comprising a first extrusion tool within which the first material can be pressed in the form of a plastic first mass flow in a direction towards the nozzle mouthpiece thereof, a second extrusion tool by means of which the second material is provided in the form of a plastic second mass flow, a channel connecting the two extrusion tools, a further nozzle by which the second material can be forced into the first material, a control unit provided for setting volume flows of the materials and a sensor connected with the control unit, wherein output signals of the sensor are coupled to the control unit and wherein the control unit generates control signals such that volumes of the first and second mass flows are controlled individually.

12. The device according to claim 11, wherein the further nozzle has a non-round cross-sectional shape.

13. The device according to claim 11, wherein the further nozzle has an elongate cross-sectional shape.

14. The device according to claim 11, wherein it comprises a valve arranged in the channel connecting the two extrusion tools.

15. The device according to claim 14, wherein the control unit is provided for controlling the valve (23).

16. The device according to claim 11, wherein it comprises at least one further extrusion tool, which is connected with the first extrusion tool by way of a channel, wherein the at least one further extrusion tool is provided for preparing a further material present in the form of a plastic mass flow.

* * * * *